US009493905B2

(12) United States Patent
Ducruet et al.

(10) Patent No.: US 9,493,905 B2
(45) Date of Patent: Nov. 15, 2016

(54) ELECTRIC HOUSEHOLD APPLIANCE WITH A STEAM GENERATING BASE CONNECTED BY A STEAM LINE TO A TOOL FOR THE VERTICAL REMOVAL OF CREASES FROM LINENS

(71) Applicant: SEB S.A., Ecully (FR)

(72) Inventors: Guy Ducruet, Lyons (FR); Audrey Panza, Salaise sur Sanne (FR); Arnaud Grienay, Lyons (FR); Lijing Zeng, Lyons (FR); Stephanie Lemaire, Saint-Symphorien-d'Ozon (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 14/524,351

(22) Filed: Oct. 27, 2014

(65) Prior Publication Data

US 2015/0114048 A1 Apr. 30, 2015

(30) Foreign Application Priority Data

Oct. 31, 2013 (FR) ..... 13 60691

(51) Int. Cl.

| | |
|---|---|
| ***D06F 73/00*** | (2006.01) |
| ***F22B 1/28*** | (2006.01) |
| ***D06F 87/00*** | (2006.01) |

(52) U.S. Cl.

CPC ..... *D06F 73/00* (2013.01); *D06F 87/00* (2013.01); *F22B 1/284* (2013.01)

(58) Field of Classification Search

CPC ..... D06F 73/00

See application file for complete search history.

(56) References Cited

U.S. PATENT DOCUMENTS

| | | | | |
|---|---|---|---|---|
| 7,516,565 | B1 | 4/2009 | Tsen | |
| 2009/0173758 | A1* | 7/2009 | Hahn | D06F 3/00 223/85 |
| 2013/0193171 | A1* | 8/2013 | Carter | D06F 1/34 223/51 |

FOREIGN PATENT DOCUMENTS

| | | | |
|---|---|---|---|
| FR | 2981668 | A1 | 4/2013 |
| WO | 2007/108577 | A1 | 9/2007 |

* cited by examiner

*Primary Examiner* — Michael Barr
*Assistant Examiner* — Jason Riggleman
(74) *Attorney, Agent, or Firm* — The Webb Law Firm

(57) ABSTRACT

Electric household appliance comprising a steam generating base (1) connected by a steam line (2) to a tool (3) such as a crease removing head for the vertical removal of creases from linens, the appliance having at least one rod (5, 6) for the suspension of an article to be ironed, the rod (5, 6) being supported by a single pole (4) extending upwards from the base (1) and capable of occupying a work position in which the rod (5, 6) is disposed transversely to the pole (4), characterized in that the rod (5, 6) in the work position extends from just one side of the pole (4) and over a length greater than 25 cm.

14 Claims, 2 Drawing Sheets

ELECTRIC HOUSEHOLD APPLIANCE WITH A STEAM GENERATING BASE CONNECTED BY A STEAM LINE TO A TOOL FOR THE VERTICAL REMOVAL OF CREASES FROM LINENS

CROSS-REFERENCE TO RELATED APPLICATION

This application claims priority to French Patent Application No. 1360691 filed Oct. 31, 2013, the disclosure of which is hereby incorporated in its entirety by reference.

FIELD OF THE INVENTION

The present invention relates to an electric household appliance with a steam generating base connected by a steam line to a tool such as a crease removing head for the vertical removal of creases from linens, and relates more particularly to an appliance with at least one rod for hanging a garment, the rod being supported by a single pole extending upwards from the base and capable of occupying a work position in which the rod is disposed transversely to the pole.

DESCRIPTION OF RELATED ART

U.S. Pat. No. 7,516,565 discloses an appliance with a steam generating base connected by a steam line to a crease removing head, wherein the appliance has a pole which extends vertically from the base and which has a top end bearing a transverse rod on which a clothes hanger can be hung.

Such an appliance has the advantage of enabling the removal of creases from a shirt by putting the latter on the clothes hanger hung from the transverse rod and then moving the crease removing head vertically over the shirt.

However, when the clothes hanger is hung from such a suspension rod, it is obviously placed crosswise in relation to the latter, in a position in which the vertical pole is disposed behind the garment to be ironed. The presence of the vertical pole behind the garment thus interferes with the user when the latter wishes to smooth the backside of the garment. Furthermore, when the crease removing head exerts pressure on the garment, the latter moves back against the vertical pole, which can then hinder the user in manipulating the head and crease the garment.

Hence an object of the present invention is to propose an appliance equipped with a clothes suspension device that makes it possible to solve these problems and which is easily and cost effectively implemented.

SUMMARY OF THE INVENTION

To this end, the invention has as an object an electric household appliance with a steam generating base connected by a steam line to a tool such as a crease removing head for the vertical removal of creases from linens, the appliance having at least one rod for hanging an article to be ironed, the rod being supported by a single pole extending upwards from the base and capable of occupying a work position in which the rod is disposed transversely to the pole, characterized in that in the work position, the rod extends from just one side of the pole and over a length greater than 25 cm.

Such a feature makes it possible to hang a cloths hanger, which typically has a width of around 40 cm, on one end of the rod in a position in which the hanger can pivot about its hook without coming into contact with the pole. Thus the pole no longer constitutes a hindrance to the ironing operation, as the hanger can be advantageously positioned parallel to the rod so as to allow totally free access to the back and to the front of the garment, the pole thus being disposed on one side of the garment to be ironed.

According to another feature of the invention, the pole is eccentrically disposed on the base.

Such an eccentric pole has the advantage of not taking up the center space above the base.

According to another feature of the invention, in the work position the rod extends horizontally above the base.

Such a feature makes it possible to obtain better stability of the appliance, greater compactness, and better ergonomics.

According to another feature of the invention, the rod has a length of around 40 cm.

Such a length makes it possible to have a rod corresponding essentially to the length of a clothes hanger.

According to another feature of the invention, the rod has an end which is fastened to the pole by means of a fastening device comprising a pivot joint and locking means which enable the pivot joint to be fixed in the position corresponding to the work position of the rod, the pivot joint allowing the rod to be moved from the work position to a storage position in which the rod is disposed alongside the pole.

Such a feature makes it possible to obtain greater compactness of the appliance in the storage position.

According to still another feature of the invention, the fastening device has a holder opposite the rod for resting the tool.

According to another feature of the invention, the rod is detachably connected to the pole.

Such a feature has the advantage of allowing the rod to be dismantled for greater compactness, notably when packaging the appliance in a box.

According to another feature of the invention, the rod has at least one clip for securing the article to be smoothed.

Such a feature makes it possible to remove the creases from an article such as a pair of pants or a curtain by hanging the latter vertically from the rod by means of the clips.

According to another feature of the invention, the rod has a suspension tab with a shape suitable for ensuring that the hook of a clothes hanger is held in a plane parallel to the suspension rod.

Such a holding of the hanger in a plane parallel to the rod makes it possible to ensure that the garment to be ironed is oriented parallel to the rod for better access to the back and front sides of the garment during ironing.

According to another feature of the invention, the suspension tab has the shape of a half-moon.

According to another feature of the invention, the device has a top rod disposed near the top end of the pole and a bottom rod disposed near the base.

According to another feature of the invention, the bottom rod bears two upwardly oriented clips and the top rod bears two downwardly oriented clips.

Such a feature makes it possible to hook the rod to the bottom portion of the article to be ironed, in order to exert tension on the latter for ensuring a better hold and facilitating the removal of creases therefrom.

According to another feature of the invention, the bottom rod is fastened onto the pole by means of a spring clip, the bottom rod capable of being moved vertically on the pole by exerting pressure on a hand lever of the clip.

Such a feature allows the user to adjust the position of the bottom rod according to the size of the garment to be ironed and allows a slight traction to be exerted on the garment to be ironed.

According to another feature of the invention, the pole is a telescopic pole.

Such a feature makes it possible to adjust the height of the pole and thus the positioning of the top rod according to the size (height) of the user and the garment to be ironed. Such a feature also makes it possible to have a compact appliance when the pole is lowered to its minimum height for storage.

According to another feature of the invention, the pole extends vertically.

BRIEF DESCRIPTION OF THE DRAWINGS

The objects, aspects, and advantages of the present invention will be more clearly understood on the basis of the following description of a particular embodiment of the invention, which is given as a non-limiting example and which refers to the appended drawings, wherein.

DESCRIPTION OF THE INVENTION

Only the elements necessary for understanding the invention have been illustrated. To make it easier to read the drawings, the same elements have the same reference numbers from figure to figure.

Figure 1:
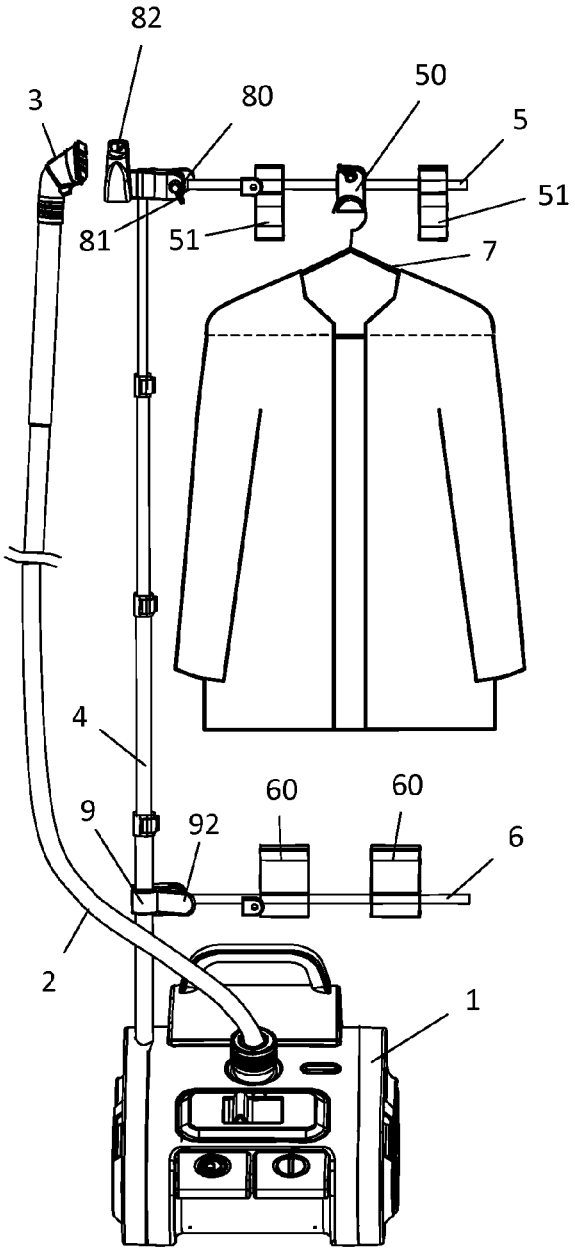
FIGS. 1 and 2 are perspective views of an ironing appliance comprising a device for hanging a garment according to a particular embodiment of the invention.
Figure 2:
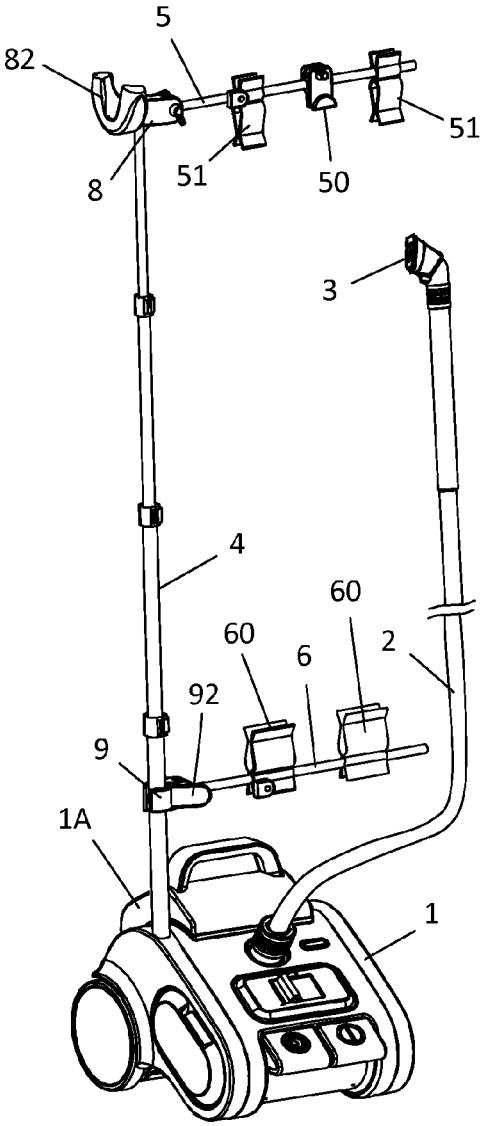

FIGS. 1 and 2 illustrate a steam ironing appliance with a base 1 housing, in a manner known per se, a steam generator connected by a steam cord 2 to a crease removing head 3, the base 1 having two wheels allowing the appliance to be moved easily by tilting the base, and a removable tank 1A equipped with a handle for facilitating the removal thereof.

More particularly according to the invention, the appliance has a device for hanging a garment, comprising a single pole 4 extending vertically from the base 1, wherein the pole advantageously has four telescopic segments and extends to a height of around 1.2 m when it is fully deployed.

Figure 3:
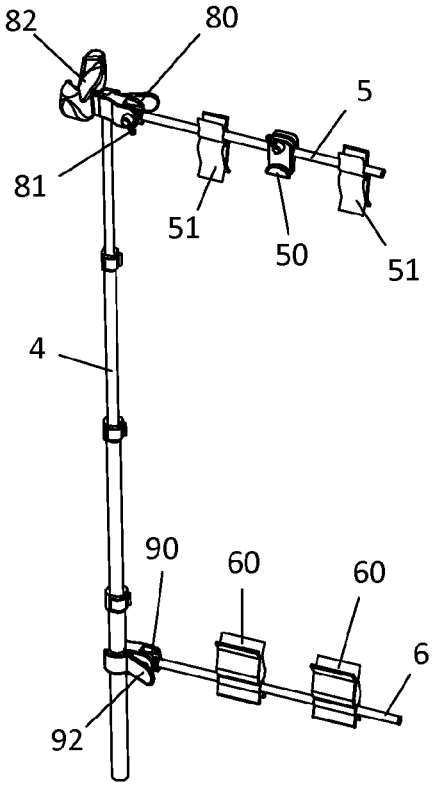
FIG. 3 is a perspective view of just the suspension device equipping the appliance of FIGS. 1 and 2, in which the rods are shown in the work position and the telescopic pole in the deployed position.

The pole 4 is advantageously fastened onto the edge of one of the lateral faces of the base 1 and bears a top rod 5 and a bottom rod 6 having a length of around 40 cm, the top 5 and bottom 6 rods being capable of occupying a work position illustrated in FIGS. 1 through 3, in which position they extend horizontally above the base 1.

The top rod 5 has two elastically deformable clips 51 disposed on either side of a suspension tab 50 fastened in the middle of the top rod 5, wherein the tab 50 and the two clips 51 are advantageously fastened onto the top rod 5 by means of clamping jaws which allow their positioning on the top rod 5 to be changed.

The suspension tab 50 preferably has a half-moon shape on which can be positioned a hook of a clothes hanger 7, the half-moon shape ensuring that the hanger 7 is held in the plane of the top rod 5, as illustrated in FIG. 1.

Figure 4:
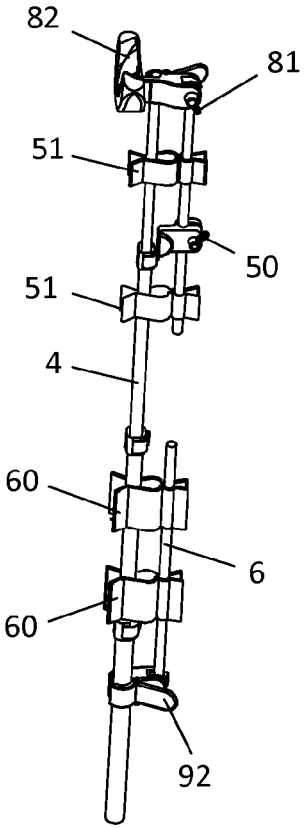
FIG. 4 is another perspective view of the suspension device of FIG. 3 with the rods illustrated in the storage position.
Figure 5:
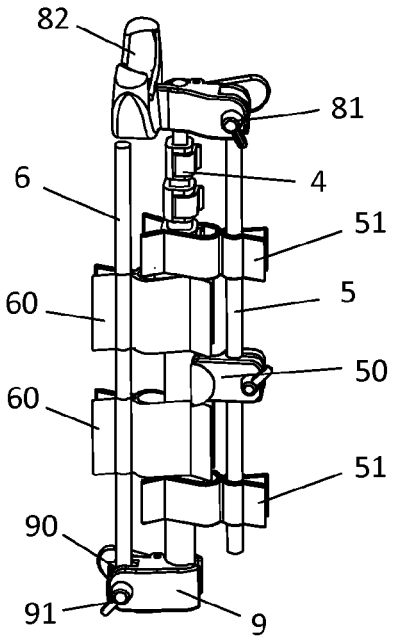
FIG. 5 is a perspective view of the suspension device of FIGS. 3 and 4 with the telescopic pole in the collapsed position and the rods in the storage position.

The top rod 5 is fastened to a top end of the pole 1 [sic] by means of a fastening device 8 comprising a pivot joint 80 which allows the top rod 5 to pivot downwards into a storage position illustrated in FIGS. 4 and 5, in which the top rod 5 is disposed vertically alongside the pole 4. The fastening device 8 of the top rod 5 is advantageously secured in a detachable manner to the top end of the pole and comprises locking means consisting of a wing nut 81 making it possible to fix the top rod in the work position or in the storage position, the fastening device 8 comprising a U-shaped holder 82 opposite the top rod 5 for resting the crease removing head 3.

The bottom rod 6 has two elastically deformable clips 60 capable of being moved laterally along the bottom rod 6, and it is fastened onto the pole 4 by means of a fastening device comprising a clip 9 brought into a closed position by a spring, wherein the clip 9 can be opened by pressing on a hand lever 92 in order to move the fastening device along the pole 4, the actuation of the hand lever 92 also allowing the bottom rod 6 to be removed from the pole 4.

Advantageously, the fastening device of the bottom rod 6 also has a pivot joint 90 allowing the bottom rod to pivot upward into a storage position illustrated in FIGS. 4 and 5, in which the bottom bar 6 is disposed vertically alongside the pole 4. Just like the one for the top rod 5, this fastening device has locking means consisting of a wing nut 91 (only visible in FIG. 5), allowing the bottom rod 6 to be fixed in the work position or in the storage position.

The functioning and the advantages procured by the appliance thus configured will now be described.

When the user wishes to iron, he or she positions the bottom 6 and top 5 rods horizontally as illustrated in FIGS. 1, 2, and 3 and then puts the article to be ironed on the hanger 7 hung on the suspension tab 50, if the article is a shirt, or he or she secures the article between the clips 51, 60 of the top and bottom rods in such a way that the article is held under slight tension, if the article is a pair of pants or a curtain.

The user now turns on the steam generator and then takes the crease removing head 3 to apply steam by moving the crease removing head 3 vertically over the article to be ironed.

During this vertical movement of the head 3, the user can smooth both sides of the article without interference from the pole 1 [sic], which saves time and procures greater ease of use. Furthermore, the article is able to recede under the pressure exerted by the head without any obstacle hindering the movement of the crease removing head 3.

The appliance equipped with such a suspension device thus has the advantage of procuring excellent ergonomics by minimizing hindrance from the vertical pole.

When the user has finished the ironing session, he or she can reduce the bulk of the appliance by loosening the wing nuts 81, 91 of the fastening devices of the bottom 6 and top 5 rods in order to swing the bottom 6 and top 5 rods into their storage position, as illustrated in FIG. 4.

The user also has the option of making the appliance even more compact in both height and width by collapsing the telescopic pole 1 and by pivoting the bottom rod 6 180° on the pole 1 before swinging the bottom 6 and top 5 rods into their storage position, as illustrated in FIG. 5.

The appliance thus configured therefore has a suspension device exhibiting the advantage of being extremely compact in the folded position.

Obviously the invention is not limited in any way to the embodiment described and illustrated herein, which was only given as an example. Modifications are still possible, notably in terms of the constitution of the various elements or by substituting equivalent techniques, without in any way exceeding the scope of protection of the invention.

Hence in an alternate embodiment not shown, the pole could be made in a single piece.

Hence in another alternate embodiment not shown, the bottom and top rods could be telescopic.

In still another alternate embodiment not shown, the suspension tab in the shape of a half-moon for holding the hanger could be replaced with a suspension tab equipped with a hole for inserting the hook of the hanger.

In another alternate embodiment not shown, the bottom and top rods could be detachably fastened to the pole and occupy just the work position when they are fastened to the pole.

In another variant not shown, the crease removing tool is a clothes iron.

The invention claimed is:

1. Electric household appliance comprising a steam generating base connected by a steam line to a tool such as a crease removing head for the vertical removal of creases from linens, the appliance having at least one rod for the suspension of an article to be ironed, the rod being supported by a single pole extending upwards from the base and capable of occupying a work position in which the rod is disposed transversely to the pole, wherein the rod in the work position extends from just one side of the pole and over a length greater than 25 cm, and wherein the pole is free of rods that extend from a side of the pole that is opposite the side the at least one rod extends; and wherein the rod has an end which is fastened to the pole by means of a fastening device comprising a pivot joint and locking means, which allow the pivot joint to be fixed in the position corresponding to the work position of the rod, the pivot joint allowing the rod to be moved from the work position to a storage position in which the rod is disposed alongside the pole.

2. Electric household appliance as in claim 1, wherein the pole is disposed eccentrically on the base.

3. Electric household appliance as in claim 2, wherein the rod extends horizontally above the base in the work position.

4. Electric household appliance as in claim 1, wherein the rod has a length of around 40 cm.

5. Electric household appliance as in claim 1, wherein the fastening device has a holder opposite the rod for resting the tool.

6. Electric household appliance as in claim 1, wherein the rod is detachably connected to the pole.

7. Electric household appliance as in claim 1, wherein the rod has at least one clip for securing the article to be ironed.

8. Electric household appliance as in claim 1, wherein the rod has a suspension tab that holds the hook of a clothes hanger in a plane parallel to the suspension rod.

9. Electric household appliance as in claim 8, wherein the suspension tab exhibits the shape of a half-moon.

10. Electric household appliance as in claim 1, wherein the device has a top rod disposed near the top end of the pole and a bottom rod disposed near the base.

11. Electric household appliance as in claim 10, wherein the bottom rod bears two upwardly oriented clips and the top rod bears two downwardly oriented clips.

12. Electric household appliance as in claim 10, wherein the bottom rod is fastened onto the pole by means of a spring clip, the bottom rod capable of being moved vertically on the pole by exerting pressure on a hand lever of the spring clip.

13. Electric household appliance as in claim 1, wherein the pole is a telescopic pole.

14. Electric household appliance as in claim 1, wherein the pole extends vertically.

* * * * *